US012139839B2

(12) United States Patent
Behr et al.

(10) Patent No.: US 12,139,839 B2
(45) Date of Patent: Nov. 12, 2024

(54) WASHING MACHINE

(71) Applicant: Miele & Cie. KG, Gütersloh (DE)

(72) Inventors: Markus Behr, Bielefeld (DE); Andrea Sudkemper, Delbrück-Hagen (DE); Robert Müther, Heikendorf (DE)

(73) Assignee: MIELE & CIE. KG, Gütersloh (DE)

( * ) Notice: Subject to any disclaimer, the term of this patent is extended or adjusted under 35 U.S.C. 154(b) by 353 days.

(21) Appl. No.: 17/283,044

(22) PCT Filed: Oct. 1, 2019

(86) PCT No.: PCT/EP2019/076603
§ 371 (c)(1),
(2) Date: Apr. 6, 2021

(87) PCT Pub. No.: WO2020/078719
PCT Pub. Date: Apr. 23, 2020

(65) Prior Publication Data

US 2021/0348319 A1 Nov. 11, 2021

(30) Foreign Application Priority Data

Oct. 15, 2018 (DE) ..... 10 2018 125 476.8

(51) Int. Cl.
*D06F 39/02* (2006.01)
*D06F 39/12* (2006.01)

(52) U.S. Cl.
CPC ..... *D06F 39/022* (2013.01); *D06F 39/12* (2013.01)

(58) Field of Classification Search
CPC ..... D06F 39/022; D06F 39/02; D06F 33/37; D06F 2105/42; A47L 15/4418; A47L 15/44
(Continued)

(56) References Cited

U.S. PATENT DOCUMENTS 4,141,311 A * 2/1979 Taylor, Jr. ..... A47L 15/4418 116/276
5,007,254 A * 4/1991 Wolfe ..... D06F 39/022 68/17 R
(Continued)

FOREIGN PATENT DOCUMENTS

DE 102009028066 A1 2/2011
EP 2743393 A1 6/2014
(Continued)

OTHER PUBLICATIONS

Krueger et al., "Automatically Controlled Washing Machine Having Fill Level Display for Laundry Treatment Agent", Feb. 2011, WO-2011012467-A1—Machine Translation (Year: 2011).*
(Continued)

*Primary Examiner* — David G Cormier
*Assistant Examiner* — Thomas Bucci
(74) *Attorney, Agent, or Firm* — Dickinson Wright PLLC

(57) ABSTRACT

A washing machine comprising a housing (2), an outer tub (15) for receiving washing liquid, a drum (16) mounted rotatably in the outer tub (15) for receiving laundry, a metering device configured to receive at least one cartridge (9*a*, 9*b*) and to meter detergent (12*a*, 12*b*) contained in the cartridge (9*a*, 9*b*) into one or the outer tub (15) and the drum (16). The housing (2) accommodates the outer tub (15), the drum (16) and the metering device and has a housing flap (5) in front of the at least one cartridge (9*a*, 9*b*). The housing flap (5) is at least partly transparent or has at least one opening such that when the at least one cartridge (9*a*, 9*b*) is arranged in the metering device, a fill level of the at least one translucent cartridge (9*a*, 9*b*) is at least partly visible from outside the housing (2).

13 Claims, 2 Drawing Sheets

(58) Field of Classification Search
USPC ..... 68/12.18
See application file for complete search history.

(56) References Cited

U.S. PATENT DOCUMENTS 5,975,352 A * 11/1999 Spriggs ..... A47L 15/4418 221/6
6,857,439 B1 * 2/2005 Perruca ..... A47L 15/4418 134/113
2010/0071777 A1 * 3/2010 Smith ..... D06F 39/022 222/325
2010/0083989 A1 * 4/2010 Classen ..... D06F 39/022 134/93
2010/0161143 A1 * 6/2010 Smith ..... D06F 39/022 700/283
2011/0132411 A1 * 6/2011 Kessler ..... D06F 39/088 134/93
2011/0154865 A1 * 6/2011 Lee ..... D06F 39/02 68/17 R
2014/0076009 A1 * 3/2014 Kim ..... D06F 39/085 68/17 R
2016/0186370 A1 * 6/2016 Kim ..... D06F 39/02 68/17 R
2016/0289883 A1 * 10/2016 Lv ..... D06F 39/02
2019/0365196 A1 * 12/2019 Durham ..... F21V 33/0044

FOREIGN PATENT DOCUMENTS

JP H0768082 A 3/1995
KR 20090101680 A 9/2009
WO WO-2011012467 A1 * 2/2011 ..... D06F 33/02

OTHER PUBLICATIONS

European Patent Office, Rijswijk, Netherlands, International Search Report of International Application No. PCT/EP2019/076603, Mailed Nov. 22, 2019, 3 pages.

* cited by examiner

WASHING MACHINE

TECHNICAL FIELD

The invention relates to a washing machine. In particular, the invention relates to a washing machine comprising a housing, an outer tub for receiving washing liquid, a drum mounted rotatably in the outer tub for receiving laundry, a metering device which is designed to receive at least one cartridge and to meter detergent contained in the cartridge into the outer tub and/or the drum, the housing accommodating the outer tub, the drum and the metering device and having a housing flap which is situated in front of the at least one cartridge that can be placed in the metering device.

BACKGROUND

It is known from undocumented prior art that such a washing machine has an empty-state sensor which is designed to detect an empty state of the cartridge placed in the metering device. The empty-state sensor only detects the empty state of the cartridge when the cartridge is empty. This can result in a wash cycle using little or no detergent. This deteriorates the washing performance.

SUMMARY

An objective underlying the invention thus is to provide a washing machine in which an empty cartridge can be prevented in time.

According to the invention, this problem is solved by a washing machine comprising a housing, an outer tub for receiving washing liquid, a drum mounted rotatably in the outer tub for receiving laundry, a metering device which is designed to receive at least one cartridge and to meter detergent contained in the cartridge into the outer tub and/or the drum, the housing accommodating the outer tub, the drum and the metering device and having a housing flap which is situated in front of the at least one cartridge that can be arranged in the metering device, wherein the housing flap is at least partly transparent or has at least one opening such that when the at least one cartridge is arranged in the metering device a fill level of the at least one translucent cartridge is at least partly visible from outside the housing.

The advantage achievable with the invention, in addition to being able to detect the fill level of the detergent in the cartridge from outside the housing, is that the solution according to the invention is inexpensive compared to the empty-state sensor.

According to the invention, the housing flap is at least partly transparent or has at least one opening such that a fill level of the at least one cartridge is at least partly visible from outside the housing when the at least one cartridge is placed in the metering device.

As a result, a user of the washing machine can visually check the fill level of the cartridge and provide a new cartridge in time to replace the cartridge running low on detergent. In order for this to function, a cartridge placed in the washing machine must be designed to be translucent or transparent. The invention is based on the concept that the fill level of the cartridge placed in the metering device is visible from outside the housing. However, the cartridge itself is not part of the subject matter of claim 1. Rather, it can be placed in the washing machine by a user if necessary. If no cartridge is placed in the metering device, part of the metering device, in particular a receiving device of the metering device, which is designed to receive the at least one cartridge, is visible from outside the housing.

The fact that the housing accommodates the outer tub, the drum and the metering device and has a housing flap which is situated in front of the at least one cartridge that can be placed in the metering device means that the housing together with the housing flap surrounds the aforementioned components, as is common in front and top loaders. The position and direction indications relate to the position of the washing machine when it is installed for operation.

The housing flap can be formed from a transparent plastic. In a preferred embodiment, the housing flap has at least one viewing window which is designed as a transparent window or an opening. The viewing window is more preferably designed as a transparent window. The housing flap preferably has a non-transparent plastic into which a transparent plastic is integrated in the manner of a window. The housing flap preferably has a number of viewing windows corresponding to a number of cartridges that can be placed in the metering device. Preferably, each cartridge that can be placed in the washing machine is assigned a viewing window and vice versa.

Each viewing window is preferably arranged in such a way that the viewing window is completely filled when a cartridge full of detergent is assigned to it, that the viewing window is less filled the less the cartridge assigned to it is filled with detergent, and that the viewing window is not filled at all as soon as the cartridge has a detergent level below a predefined level. This allows the user to easily visually detect and evaluate the fill level. The predefined level is preferably a level of the detergent in the cartridge which is sufficient to carry out fewer than five wash cycles, preferably fewer than three wash cycles. This gives the user sufficient time to have a new cartridge ready until the cartridge running low is empty. Another advantage herein is that the fill level of the detergent is visible to the user and that fill levels other than an empty state can be detected.

In a preferred embodiment, each viewing window is assigned a scale which is designed to display a scaled fill level of the cartridge in question. The scale also supports the user in identifying and evaluating the fill level of detergent in the cartridge. The scale can be a scale that is jointly assigned to two viewing windows. The scale can be designed as one or more lines extending next to the viewing window to which numbers are assigned, for example as indications for a quantity of detergent in the cartridge. For example, the scale is designed to indicate the fill level of the amount of detergent contained in the cartridge as a percentage or to indicate the number of possible wash cycles with the amount of detergent contained in the cartridge according to the fill level.

The metering device is preferably designed to receive at least one elongate cartridge. As a result, the cartridge can utilize installation space without significantly limiting the size of the outer tub. The metering device is preferably designed to receive the at least one elongate cartridge in an inclined position along its longitudinal extent. As a result, when the fill level is low, the detergent is directed into a depression, namely the lowest point of the cartridge, and can be effectively metered even when the fill level is low. The elongate cartridge is preferably placed in such a way that it is inclined downwards in the direction of the interior of the washing machine.

In a preferred embodiment, the washing machine furthermore has a lighting device which is arranged, aligned and designed in such a way that it illuminates the at least one cartridge when the at least one cartridge is placed in the metering device. This further improves the visibility of the fill level of the detergent in the cartridge from outside the housing. As a result, not only the fill level but also the presence of a cartridge in the metering device is detectable from outside the housing. The lighting device is preferably arranged behind the cartridge. As a result, the lighting device is arranged, aligned and designed to illuminate in the direction of the viewing window. The lighting device can be designed to illuminate the cartridge only when the washing machine is in operation.

The at least one lighting device is preferably designed as at least one light-emitting diode. This is an inexpensive and long-lasting lighting device.

In a preferred embodiment, the at least one cartridge is placed in the metering device and is designed to be translucent.

The term "washing machine" comprises a pure washing machine and a combination device such as a washer-dryer. The washing machine is preferably a front loader.

An embodiment of the invention is shown in the drawings in a purely schematic manner and not to scale and will be described in more detail below.

DETAILED DESCRIPTION OF THE DRAWINGS

Figure 1:
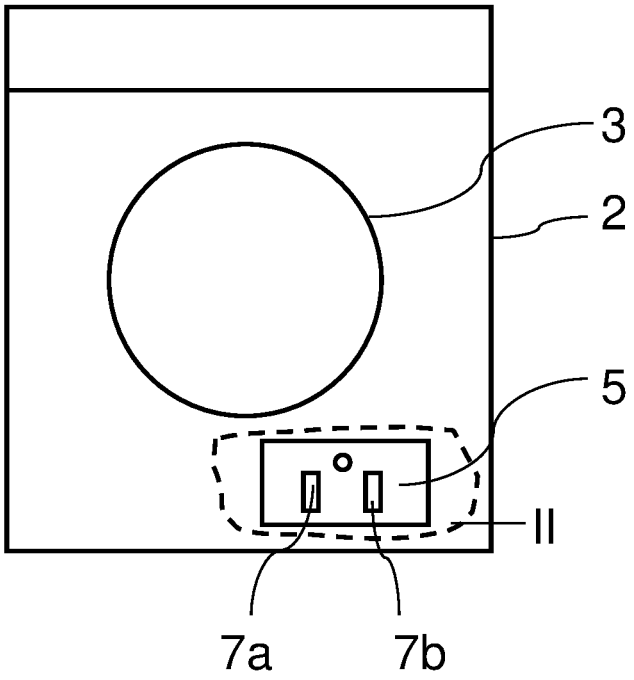
FIG. 1 is a plan view of a washing machine according to the invention.

FIG. 1 is a plan view of a washing machine according to the invention. The washing machine has a housing 2 which accommodates an outer tub (not shown) for receiving washing liquid, a drum (not shown) rotatably mounted in the outer tub for receiving laundry and a metering device (not shown). The washing machine also has a door 3 which is integrated into the housing 2 and which closes a loading opening (not shown) through which the drum can be loaded with laundry. The metering device is designed to receive two cartridges (not shown) and to meter detergent (not shown) contained in the cartridges into the outer tub and/or the drum. The washing machine has a housing flap 5 which is situated in front of the two cartridges which can be arranged in the metering device. The housing flap is designed to be at least partly transparent, such that when the two cartridges are placed in the metering device, a fill level of the two translucent cartridges is at least partly visible from outside the housing 2. The housing flap 5 is formed from a non-transparent plastic, in which two viewing windows 7*a*, 7*b* made from a transparent plastic are integrated.

Figure 2:
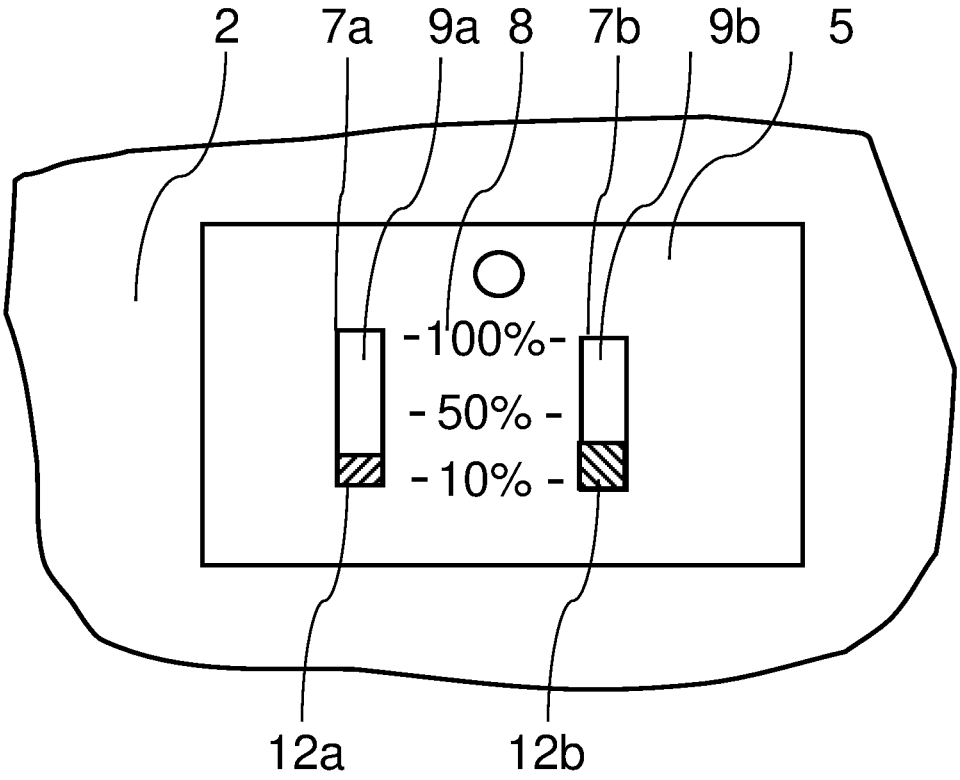
FIG. 2 is an enlarged partial view of the washing machine shown in FIG. 1 with the housing flap closed.

FIG. 2 shows an enlarged partial view of the washing machine shown in FIG. 1 with the closed housing flap within the line II. A fill level of the detergent 12*a* and 12*b* in the respective cartridges 9*a*, 9*b* can be seen in each of the viewing windows 7*a*, 7*b*. A common scale 8 is assigned to the two viewing windows 7*a*, 7*b*, which is designed to display a scaled fill level of detergent 12*a*, 12*b* in the respective cartridges 9*a*, 9*b*.

Figure 3:
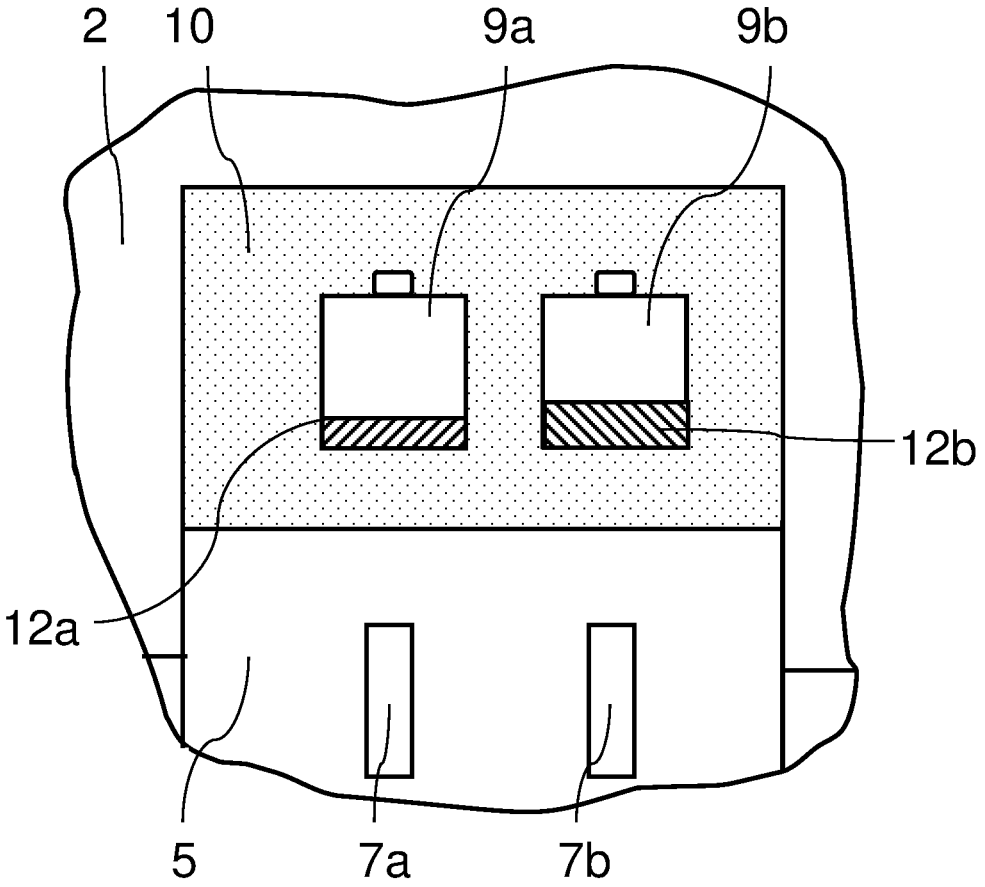
FIG. 3 is a view of the washing machine shown in FIG. 2 with the housing flap open.

FIG. 3 shows a view of the washing machine shown in FIG. 2 with the housing flap open. The housing flap 5 is open such that the two cartridges 9*a*, 9*b*, which contain the detergent 12*a* and 12*b*, respectively, are completely visible and can be removed from the washing machine. The cartridges 9*a*, 9*b* are placed in the metering device 10. The cartridge 9*a* is assigned to the viewing window 7*a*, and the cartridge 9*b* is assigned to the viewing window 7*b*.

Figure 4:
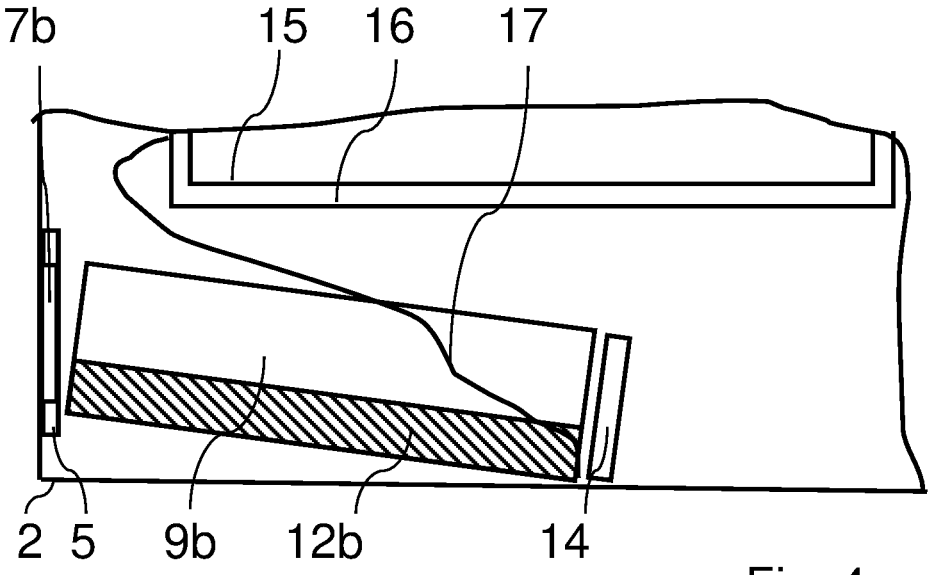
FIG. 4 is a partial cross-sectional view of the washing machine shown in FIG. 1.

FIG. 4 shows a partial cross-sectional view of the washing machine shown in FIG. 1. The housing flap 5 has the viewing window 7*b* which is arranged such that the fill level of the detergent 12*b* in the cartridge 9*b* is detectable from outside the housing 2. The metering device, which is not shown for the sake of clarity, is designed to receive the elongate cartridge 9*b* in an inclined position along its longitudinal extent. The washing machine also has a lighting device 14 which is arranged, aligned and designed in such a way that it illuminates the cartridge 9*b*. Said lighting device is arranged behind the cartridge 9*b* such that it illuminates in the direction of the viewing window 7*b* during operation. The washing machine has the outer tub 16 and the drum 15 mounted therein. A conduit 17 of the metering device is arranged in such a way that it is suitable for guiding the detergent 12*b* into the outer tub 16 or the drum 15 during a metering process.

LIST OF REFERENCE CHARACTERS

2 Housing
3 Door
5 Housing flap
7*a*, 7*b* Viewing window
8 Scale
9*a*, 9*b* Cartridge
10 Metering device
12*a*, 12*b* Detergent
14 Lighting device
15 Outer tub
16 Drum
17 Conduit

What is claimed is:

1. A washing machine comprising:

a housing, an outer tub for receiving washing liquid, a drum mounted rotatably in the outer tub for receiving laundry, a metering device configured to receive at least one cartridge and to meter detergent contained in the at least one cartridge into one of the outer tub and the drum, wherein the at least one cartridge is elongated and defines a longitudinal axis, and wherein the metering device is configured to receive the at least one cartridge in an inclined position where the longitudinal axis is inclined relative to horizontal, wherein the housing accommodates the outer tub, the drum and the metering device and has a housing flap in front of a location of the at least one cartridge that can be arranged in the metering device, wherein the housing flap is at least partly transparent or has at least one opening to define at least one viewing window such that when the at least one cartridge is placed in the metering device, a fill level of the at least one cartridge is at least partly visible from outside the housing, wherein the at least one viewing window is configured and arranged in such a way that the at least one viewing window is completely covered by detergent when a respective cartridge placed in the metering device behind the at least one viewing window is full of detergent, that the at least one viewing window is partially covered by detergent when the respective cartridge is partially filled with detergent above a predefined level, and that the at least one viewing window is not covered at all by detergent when the respective cartridge has a detergent level below the predefined level, the predefined level of the detergent being less than five wash cycles, wherein at least one lighting device is arranged behind the at least one cartridge to illuminate the at least one cartridge towards the direction of the housing flap.

2. The washing machine according to claim 1, wherein each of the at least one viewing window is assigned a scale configured to show a scaled fill level of the detergent of a respective cartridge behind the viewing window.

3. The washing machine according to claim 1, wherein the metering device is configured to receive the elongated at least one cartridge in a lengthwise inclined position, and the elongated at least one cartridge is placed inclined downward toward an inside of the housing.

4. The washing machine according to claim 1, wherein the at least one lighting device is oriented to illuminate the at least one cartridge toward the direction of the at least one viewing window.

5. The washing machine according to claim 1, wherein the at least one lighting device is designed as a light-emitting diode.

6. The washing machine according to claim 1, wherein the at least one cartridge is placed in the metering device and is translucent.

7. The washing machine according to claim 1, wherein the at least one lighting device is located on a side of the at least one cartridge that is opposite the housing flap.

8. The washing machine according to claim 1, wherein the at least one lighting device illuminates through a length of the at least one cartridge.

9. The washing machine according to claim 1, wherein a forward-most bottom corner of the at least one cartridge is positioned vertically below a bottom edge of the at least one viewing window.

10. The washing machine according to claim 1, wherein a bottom-most forward corner of the at least one cartridge is positioned vertically below a bottom edge of the at least one viewing window.

11. The washing machine according to claim 1, wherein the at least one cartridge has a bottom wall that is planar and lies in a plane that is inclined relative to horizontal.

12. The washing machine according to claim 1, wherein the predefined level of the detergent is less than three wash cycles.

13. The washing machine according to claim 1, wherein a rearward-most bottom corner of the at least one cartridge is positioned vertically below a bottom edge of the at least one viewing window.

* * * * *